United States Patent [19]

Eisenmann

[11] Patent Number: 4,649,731

[45] Date of Patent: Mar. 17, 1987

[54] FORGING DIE

[75] Inventor: Rolf Eisenmann, Krefeld, Fed. Rep. of Germany

[73] Assignee: Thyssen Industrie AG, Schmiedetechnik/Bergbautechnik, Wanheim, Fed. Rep. of Germany

[21] Appl. No.: 708,335

[22] Filed: Mar. 5, 1985

[51] Int. Cl.[4] ..... B21D 22/00

[52] U.S. Cl. ..... 72/352; 72/354; 72/358; 72/402

[58] Field of Search ..... 72/354, 357, 358, 402, 72/403, 352, 344

[56] References Cited

U.S. PATENT DOCUMENTS

| | | | |
|---|---|---|---|
| 585,821 | 7/1897 | Kent | 72/353 |
| 1,397,566 | 11/1921 | Walter | 72/344 |
| 2,105,289 | 1/1938 | Lobdell, Jr. | 72/316 |
| 2,744,426 | 5/1956 | Lyon | 72/354 |
| 4,466,266 | 8/1984 | Gardner | 72/357 |

FOREIGN PATENT DOCUMENTS

| | | |
|---|---|---|
| 0077160 | 4/1983 | European Pat. Off. . |
| 3000405 | 7/1980 | Fed. Rep. of Germany . |
| 0989585 | 4/1965 | United Kingdom . |
| 1281711 | 7/1972 | United Kingdom . |

*Primary Examiner*—Lowell A. Larson
*Assistant Examiner*—David B. Jones
*Attorney, Agent, or Firm*—Antonelli, Terry & Wands

[57] ABSTRACT

In a forging die including a lower die with an embossing insert, an upper die and actuating elements displaceable to form with the upper die and the lower die an embossing groove receiving a blank to be forged, a locking member, cooperating with the actuating elements, is provided to lock the latter in a closed position.

3 Claims, 4 Drawing Figures

FORGING DIE

BACKGROUND OF THE INVENTION

The present invention relates to a forging die for forging cylindrical elements having undercuts.

Forging dies of the type under discussion normally include a lower die portion, in which an embossing insert is arranged, and a motor-driven actuating upper die portion as well as a control system for controlling the movable elements of the die.

Cylindrical hollow elements having a number of flanges on the peripheral outer surface, for example rollers of double-wreath chains, are formed nowdays of two respectively forged pieces connected to each other by welding. Forging of such double-flange rollers is obtained in forging dies or by hammers or in embossing machines so that first an outer or larger flange or crown is forged on the roller. After the deburring and drilling of such a forged piece a second flange is formed and deburred in a further method with an additional tool.

Tools provided with wedge slides actuated by easily operating dies or molds, can be also such tools.

None of the known methods, however can be utilized for producing hollow elements having multi-flanges.

SUMMARY OF THE TNVENTION

It is an object of the present invention to provide an improved forging die.

It is another object of this invention to provide a forging die in which a forging of cylindrical hollow elements, having undercuts which form a double flange or a number of flanges, would be possible in one operation step and in one die.

Yet another object of this invention is to provide a control of a die, which would be easily incorporated in a conventional control system such as a hydraulic system of a conventional forging die.

These and other objects of the invention are attained by a forging die for producing cylindrical objects, having undercut flanges, comprising a lower die having an embossing insert therein; a motor-driven upper die movable toward said lower die; actuating means subdivided in a vertical plane into two actuating elements which define with an upper limiting surface of the embossing insert an embossing groove receiving a blank, said actuating elements being motor-driven and horizontally movable between an open position and a closed molding position; and at least one locking member which locks said actuating elements in said closed position.

Due to the provision of the locking member cooperating with horizontally movable actuating elements it is possible to modify an easily operating conventional forging die so that forging of one-piece, hollow cylindrical objects with a number of flanges, particularly double-flange rollers, would be possible in one operational step by deforming.

For producing cylindrical objects with undercuts a plurality of tools and a plurality of forging machines have been required simultaneously up till now.

Due to the present invention the die is formed with separate embossing halves which are closed during the deforming process and which are controlled by hydraulic and electrical means.

The forging die according to the invention may have the following elements:

1. a lower die with the embossing insert, which may have, for example dimensions 900×900×400 mm;

2. two actuating elements which are motor-driven and controlled in an open and closed position;

3. a locking member, which is preferably also motor-drive and controlled in the die by a hydraulic system; and 4. an upper die.

The actuating elements also known as die jaws can be closed or opened by double-acting hydraulic cylinder of the die hydraulic system.

The opening of the locking member can be effected by the normally available push rod of the die, which ejects the completely formed object from the embossing insert. The push rod can cooperate with the piston-cylinder units which include intermediate pistons and in connection with the die control system make this process possible and at the same time they are necessary in connection with a forging stroke for closing and clamping the object to be forged.

According to a further feature of this invention the forging die may include hydraulic piston-cylinder units which are interchangeably loadable at both sides with pressure of a pressure medium, particularly hydraulic oil, said actuating elements being movable between the open and closed position by said piston-cylinder units.

The actuating elements may be two halves of a ring-shaped member and are seamlessly engageable with said embossing insert so as to limit said embossing groove in said closed position.

Each of the actuating elements may have an outer conical wall surface, said locking member may also have a conical inner wall surface cooperating with the conical surface of each actuating element so as to releasably engage the same.

It is particularly advantageous that the die may further include locking hydraulic piston-cylinder units interchangeably loadable at both sides with pressure of a pressure medium and acting on an upper side of said locking member so as to cause the engagement of the conical surface of the locking member with the conical surface of each actuating element. Thereby it is possible that the locking member and actuating elements cooperating therewith would be controlled by a hydraulic system of the forging die.

Advantageously the forging die of this invention may further include unlocking means acting on an underside of said locking member and being motor-driven to move in a vertical plane, and a pushrod for pushing a forged object away from said embossing groove and actuated by said unlocking means. In this case the unlocking means is also controlled by a pressure of a pressure medium, particularly hydraulic medium, by means of the hydraulic system of the die. Thus the opening of the locking member can be effected by the push rod normally available in the die; the push rod in its second step of the movement pushes a forged object out from the embossing insert. This forged object may be a rotation-symmetrical roller, particularly for roller chains having an undercut which forms at least two flanges.

The entire control system of the forging die of this invention may comprise the following means:

(a) two actuating elements horizontally movable between an open and closed position and first piston-cylinder units for moving said actuating elements between the open and closed position;

(b) a locking member and second piston-cylinder units loadable with pressure medium and acting on said locking member to lock said actuating elements in the closed position;

(c) an embossing insert having an embossing groove into which a blank to be forged is inserted after said groove has been sprinkled;

(d) a manipulator; and (e) a push rod for pushing the object out from said groove, and means for unlocking said locking member and movable in a vertical direction upwardly, said unlocking means being operative in a first stage to move said locking member to an open position whereas said actuating elements are moved by said first piston-cylinder units to an open position and in a second stage to move said push rod to push the object out from said groove, said object being then removed from said groove by said manipulator and subjected to deburring and drilling.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
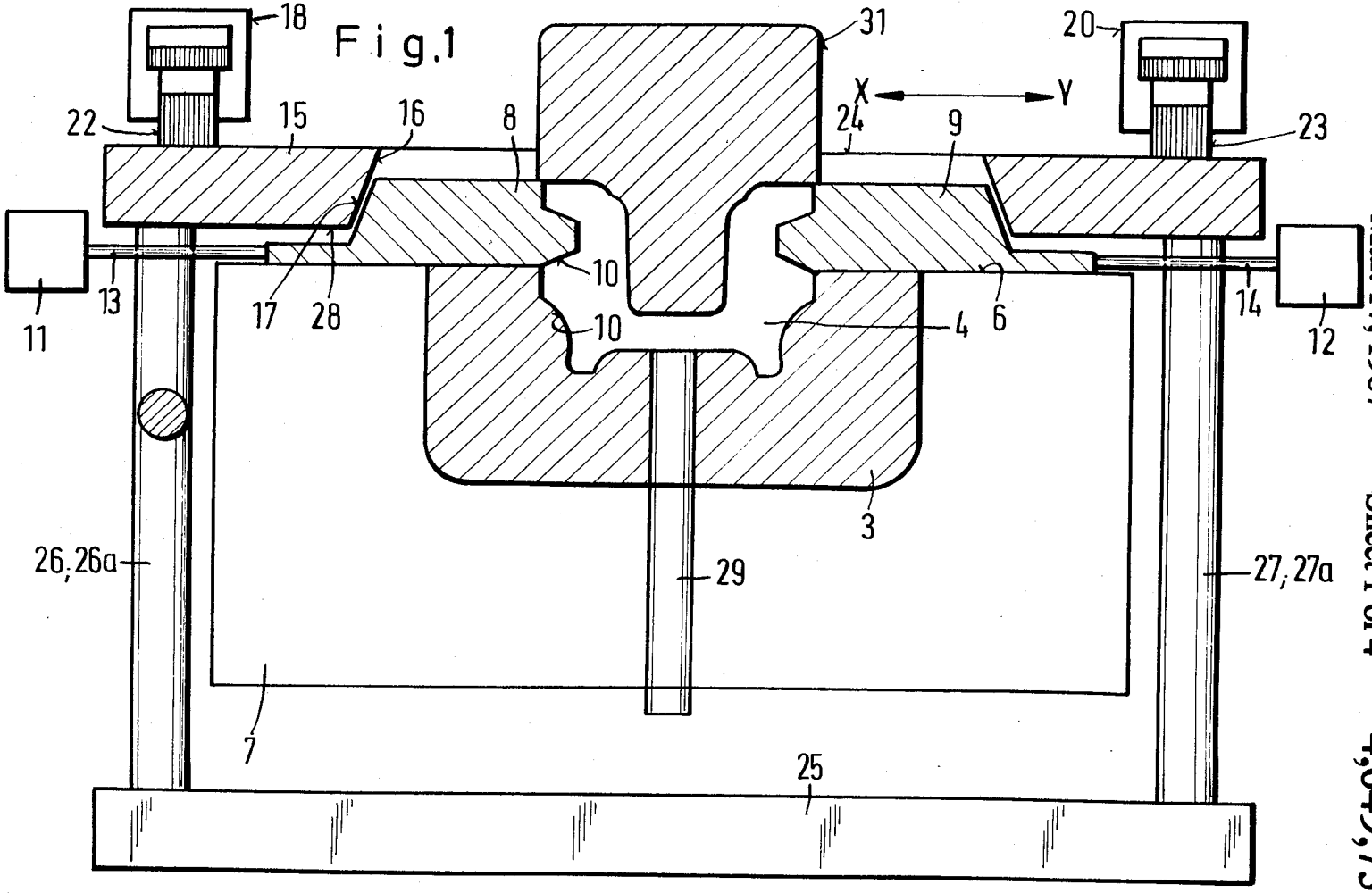
FIG. 1 is a schematic side view, partially in section, of a forging die with controlled tool active elements and an adjustable forging push rod.
Figure 2:
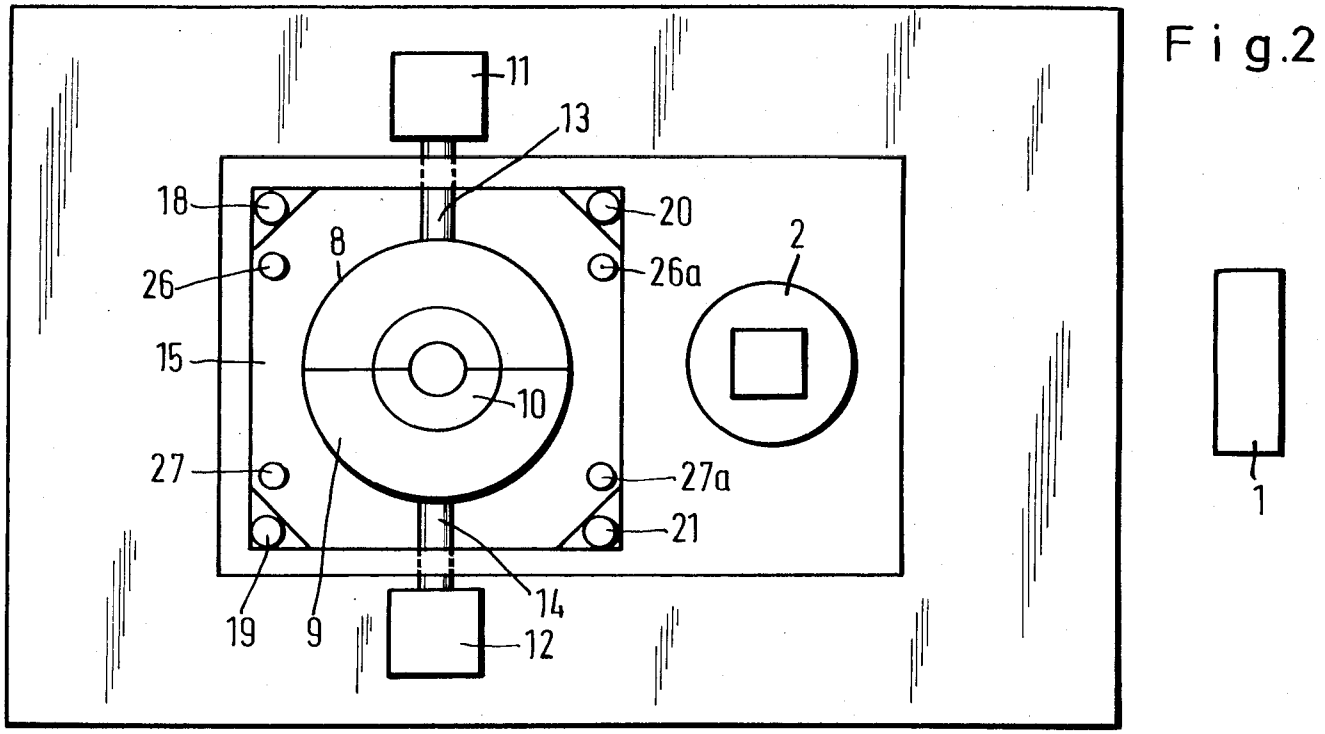
FIG. 2 is a top plan view of FIG. 1.

Referring now to the drawings in detail, and firstly to FIGS. 1 and 2 thereof, it will be seen that reference numeral 1 designates a manipulator which brings a non-illustrated heating block to a forging element 2. The heating block during the forging operation, is released from the ignition system attached thereto and is brought to a predetermined necessary position.

Manipulator 1 feeds a blank to be forged into a forging tool or die which is comprised of a lower die 7 having an embossing insert 3. An actuating part of the forging tool is arranged in an upper horizontal plane 6. This actuating part in the exemplified embodiment includes two actuating elements 8 and 9 which form at their end sides, facing toward each other, an embossing surface 10 which limits an embossing groove 4 of the embossing insert 3. Insert 3 with forging elements 8 and 9 form a lower die while a member 31 constitutes an upper die of the forging die. The die actuating elements 8 and 9 are movable in a horizontal plane in the direction of arrows X or Y to an open position or to a closed position illustrated in FIG. 1. For this purpose each die actuating element is provided with a piston-cylinder unit 11, 12 loaded at least with one pressure medium, for example hydraulic oil. Piston rods 13 and 14 of the respective hydraulic units 11, 12 are connected to the actuating tool elements 8 and 9, respectively.

Reference numeral 15 denotes a plate like locking element which is formed either of a ring-shaped member encircling the die actuating elements 8 and 9 or of a supplement to a ring-shaped member. A plate-like locking element 15 has a conical surface 16 diverging downwardly while actuating elements 8 and 9 have conical wall surfaces 17 tapering upwardly and cooperating with the conical surface 16 so that the forging die becomes locked in its closed position as shown in FIG. 1. The plate-shaped locking element 15 is moved to this closed position by means of four piston-cylinder units 18, 19, 20 and 21 positioned at respective corners of the locking element and having respective piston rods for example 22 and 23 (FIG. 1) which act on the upper surface 24 of locking element 15 to move the latter in contact with conical surfaces 16, 17. The piston-cylinder units 19 through 21 are adjustably loadable at both sideswith the pressure of pressure medium, preferably hydraulic oil.

Reference numeral 25 designates a traverse of a push rod. Four or more rod-like extensions 26, 26*a* and 27, 27*a* are provided on traverse 25. These rod-like extensions cooperate with the underside of the locking element 15 oppositely to the actuating surface, on which piston-cylinder units 18 through 21 act. A push rod 29 for pushing the forged object out from groove 4 is arranged at the distance from traverse 25.

The mode of operation of the forging die of the present invention is as follows:

A non-illustrating heating block is brought by manipulator 1 to a forging tool 2, and via a following upsetting operation is released from the ignition system and brought to a predetermined shape (pancake). Die actuating elements 8 and 9 are closed due the respective loading of the piston-cylinder units 11 and 12 with pressure medium and locked in the closed position by the locking plate-like element 15 by means of four piston-cylinder units 18, 19, 20 and 21.

Then the embossing groove 4 is sprinkled and a blank to be forged is inserted in that groove by manipulator 1.

The movable upper die member 31 displaces the material and fills the embossing groove of the forging die. An excessive material can be removed, from the embossing groove 4 via an overflow passage provided in the forging die in a conventional manner.

If four piston-cylinder units 18, 19, 20 and 21 are now unloaded the traverse 25 with rod-like extensions 26, 26*a* and 27, 27*a* is displaced in the upward direction so as to act on the underside 28 of locking element 15 to displace the latter, for example by about 60 mm.

Piston-cylinder units 11 and 12 are controlled by controlling the pressure of a pressure medium so that actuating elements 8 and 9 are horizontally moved to the open position.

Finally a freely programmable manipulator 1 removes a forged piece 30 from the embossing groove 4 of the forging die. The deburring and drilling of holes are then executed.

Figure 3:
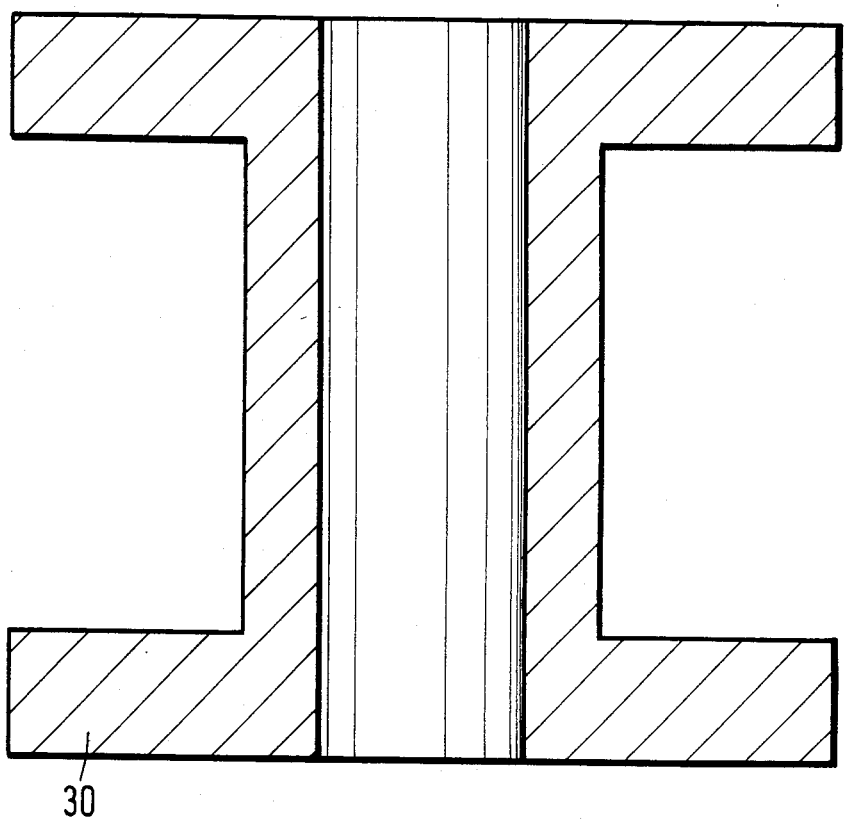
FIG. 3 is an axial sectional view of a double-flange roller formed in the forging die according to the invention.
Figure 4:
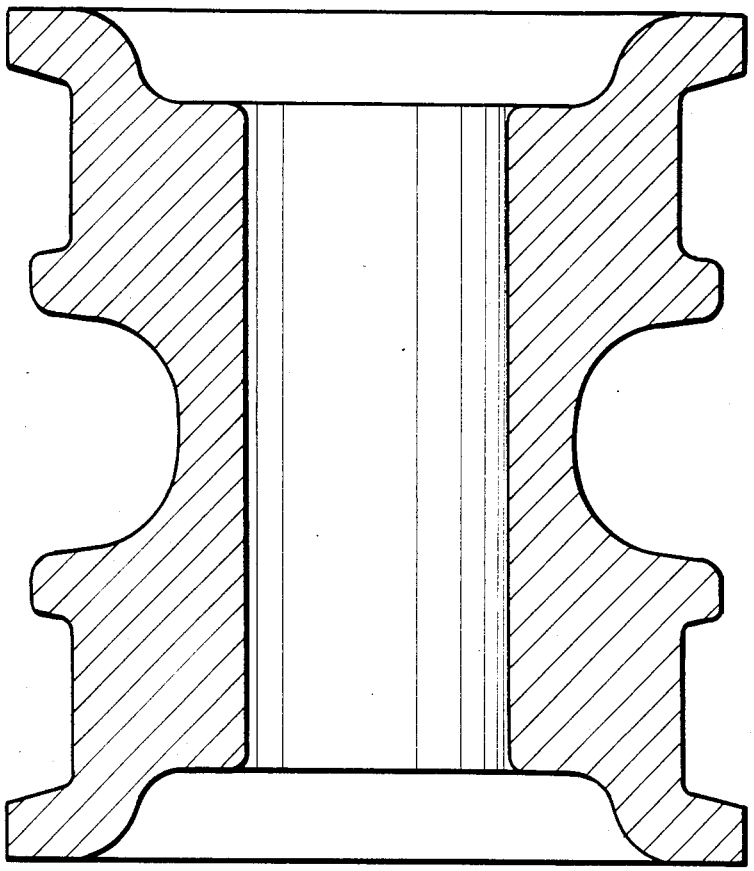
FIG. 4 is an axial sectional view of a multi-flange roller.

The multi-flange roller 30 shown in FIG. 4 can be formed in the forging die of FIG. 1. A double-flange roller 30 of FIG. 3 can be formed in a respective forging die, in which the surface 10 would be correspondingly adjusted.

The present invention significantly facilitates the method of forging cylindrical hollow elements having multi-flange shapes due to a combination of a necessary molding step during a forging stroke and the use of a conventional commercially available and simple forging die. The present invention is not limited to manufacturing of chain rollers or milti-flange rollers, for example double-flange rollers, but can be also utilized for forging complex elements with undercuts, in which a hollow interior or an outer shape with many flanges are to be produced by forging. In all instances a simple commercially available forging die, provided with a hydraulic feeding system and control, can be used, in which a complex forging tool can be actuated via a modification of the die kinematics (multiple action).

It will be understood that each of the elements described above, or two or more together, may also find a useful application in other types of forging dies differing from the types described above.

While the invention has been illustrated and described as embodied in a forging die, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A forging die for producing cylindrical objects, having undercut flanges, comprising a lower die having an embossing insert therein; a motor-driven upper die movable towards said lower die; actuating means subdivided in a vertical plane into two actuating elements which define with an upper limiting surface of the embossing insert an embossing groove receiving a blank, said actuating elements being horizontally movably driven between an open position and a closed molding position; at least one locking member for locking said actuating elements in said closed positions; hydraulic piston-cylinder units adapted to act on at least portions of the at least one locking member, said hydraulic piston-cylinder units being loadable at both sides with pressure of a pressure medium and with said actuating elements being movable between the open and closed position by said piston-cylinder units; unlocking means acting on an underside of said locking member and being motor-driven to move in a vertical plane; a push rod for pushing a forged object away from said embossing groove and actuated by said unlocking means; and wherein each of said actuating means has an outer conical surface, said locking member has a conical inner surface cooperating with the conical surface of each actuating element so as to releasably engage the same.

2. The die as defined in claim 1, wherein said actuating elements are two halves of a ring-shaped member and are seamlessly engageable with said embossing insert so as to limit said embossing groove in said closed position.

3. A forging die for producing cylindrical objects having undercut flanges, comprising a lower die and an upper die vertically movable towards the lower die; and a control system comprising:

(a) two actuating elements horizontally movable between an open and closed position, and first piston-cylinder units for moving said actuating elements between the open and closed position, each of said actuating elements including an outer conical surface;

(b) a locking member, and second piston-cylinder units loadable with pressure medium and acting on at least a portion of an upper side of said locking member to lock said actuating elements in the closed position, said locking member having a conical inner surface cooperating with the conical surface of each actuating element so as to releasably engage the same;

(c) an embossing insert having an embossing groove into which a blank to be forged is inserted after said groove has been sprinkled;

(d) a manipulator; and (e) a push rod for pushing the object out from said groove, and means for unlocking said locking member and movable in a vertical direction upwardly, said unlocking means being operative in a first stage to move said locking member to an open position whereas said actuating elements are moved by said first piston-cylinder units to an open position and in a second stage to move said push rod to push the object out from said groove, said object being then removed from said groove by said manipulator and subjected to deburring and drilling.

* * * * *